US006578464B2

(12) United States Patent
Ebersole, Jr. et al.

(10) Patent No.: US 6,578,464 B2
(45) Date of Patent: Jun. 17, 2003

(54) RECOIL MITIGATION DEVICE

(75) Inventors: Harvey Nelson Ebersole, Jr., Columbus, OH (US); Bradley Gene DeRoos, Dublin, OH (US)

(73) Assignee: Battelle Memorial Institute, Columbus, OH (US)

( * ) Notice: Subject to any disclaimer, the term of this patent is extended or adjusted under 35 U.S.C. 154(b) by 0 days.

(21) Appl. No.: 09/942,409

(22) Filed: Aug. 29, 2001

(65) Prior Publication Data

US 2003/0041724 A1 Mar. 6, 2003

(51) Int. Cl.[7] ..... F41A 25/00
(52) U.S. Cl. ..... 89/42.01; 89/177; 42/1.06
(58) Field of Search ..... 89/42.01, 43.01, 89/1.701, 177; 42/1.06

(56) References Cited

U.S. PATENT DOCUMENTS

| | | | | |
|---|---|---|---|---|
| 4,514,921 A | | 5/1985 | Burkleca | |
| 4,656,921 A | * | 4/1987 | Zierler | 89/43.01 |
| 4,875,402 A | * | 10/1989 | Metz | 89/42.01 |
| 4,924,751 A | * | 5/1990 | Metz et al. | 188/316 |
| 4,972,760 A | | 11/1990 | McDonnell | |
| 5,353,681 A | | 10/1994 | Sugg | |
| 5,617,664 A | | 4/1997 | Troncoso | |

OTHER PUBLICATIONS

National Institute of Justice Final Report; Law Enforcement Robot Technology Assessment; 4.0 Validating & Prioritizing User Needs; Aug. 23, 2001; pp 1–14.

Mini De Armer Disruptor Recoilless Stand Off; RE 9–9; RE 6.7–12; Richmond EEI Limited; Armtec Estate, North Lopham, Norfolk IP22 2LR, England.

Midi De Armer Disruptor Recoilless Stand Off; RE 12–12/28; Richmond EEI LTD.; Armtec Estate, North Lopham, Norfolk IP22 2LR, England.

Maxi De Armer Disruptor Recoilless Stand Off; RE 70 M3; Richmond EEI Limited; Armtec Estate, North Lopham, Norfolk, IP22 2LR, England.

Proparms History Products Contacts News; Proparms Limited Products; Feb. 21, 2000; http://www.proparms.com/index.htm.

* cited by examiner

*Primary Examiner*—J. Woodrow Eldred

(57) ABSTRACT

A recoil mitigation device is provided for a projectile-firing device, such as an explosives disrupter, in which a brake is attached to a barrel of the projectile-firing device and the projectile-firing device/brake combination is positioned coaxially within a tube, the tube secured to a frame or other suitable foundation. The brake includes two or more brake shoes positioned within an annular free space defined by the outer surface of the barrel and the inner surface of the tube and adapted to frictionally contact the inner surface of the tube. An apparatus is attached to the barrel for limiting the lateral movement of the brake shoes and there is an apparatus for urging the brake shoes in an outward radial direction against the inner surface of the tube, whereby when a projectile is fired from the barrel, the brake mitigates the recoil of the projectile-firing device.

30 Claims, 7 Drawing Sheets

RECOIL MITIGATION DEVICE

The invention was not made by an agency of the United States Government nor under contract with an agency of the United States Government.

FIELD OF THE INVENTION

This invention relates to projectile-firing devices and particularly to methods of mitigating the recoil of such devices. More particularly, the present invention relates to utilizing friction for mitigating the recoil of a projectile-firing device designed to de-arm an explosives device, commonly known in the art as explosives disrupters.

BACKGROUND OF THE INVENTION

In any gun system, or more generally, projectile-firing device, conservation of momentum provides that the momentum carried by the projectile and the gases is equal to, but in the opposite direction of, the momentum imparted to the device. The momentum imparted to the device is, in turn, equal to the recoil force integrated over time, or the impulse. This is commonly referred to as the "kick" experienced when a gun is fired. While the total amount of momentum for a given projectile fired at a given velocity cannot be changed, it can be managed. The force-time profile can be changed from a very high, short-lived force to a longer, much lower amplitude force pulse.

Present recoil-mitigation devices utilize complex and expensive hydraulics, pneumatics, pistons, springs, friction, or some combination thereof In addition, present devices are integral to the projectile-firing device and, therefore, not always easily or quickly adaptable to varying situations. Examples include U.S. Pat. No. 4,514,921 (coil spring compression), U.S. Pat. No. 4,656,921 (hydraulic fluid), U.S. Pat. No. 4,972,760 (adjustable recoil spring), U.S. Pat. No. 5,353,681 (recoil spring, friction, and pneumatics), and U.S. Pat. No. 5,617,664 (recoil spring).

In the particular case of some explosives disrupter devices for de-arming explosives devices, there may be no recoil mitigation. Disrupter devices are typically attached to a support frame mounted on the ground or mounted on a remote-controlled robot whereby the device can be triggered from a relatively safe distance to fire a projectile into an article suspected of containing a bomb or other explosive. Such devices are generally of a single-shot design and produce a significant impulse-oftentimes sufficient to propel the support frame/robot backwards, cause it to topple over, and/or sustain significant damage. Depending upon the situation, such devices may be called upon to fire a variety of projectiles at a variety of velocities from a variety of support frame/robots. This in turn creates a variety of recoil forces requiring, in turn, a variety of recoil mitigation solutions tailored to each support frame/robot. For example, the momentum imparted to the device from a column of water, often used to disarm soft-package bombs such as suspected briefcase bombs, may vary from close to 5 pounds-force-seconds at a low velocity to over 9 pounds-force-seconds at a high velocity (140 milliliter load at a velocity of 1000 feet per second) and even as high as 12 pounds-force-seconds. Metal slugs impart momentum in the range of 4 pounds-force-seconds to 6 pounds-force-seconds.

A general rule of thumb for a weapon without recoil mitigation fired by a human is that the momentum should not exceed 3 pounds-force-seconds. By comparison, the momentum carried by a 150 grain projectile fired from a 30-06 rifle at a velocity of 2810 feet per second is approximately 1.87 pounds-force-seconds. Thus, the momentum generated by an explosives disrupter can be relatively significant.

Therefore, there is a need for a recoil-mitigation device which overcomes these disadvantages.

BRIEF DESCRIPTION OF THE INVENTION

According to the present invention, a recoil mitigation apparatus is provided. The apparatus includes brake shoes adapted to be interposed in a free space between a tube and the barrel of a projectile-firing device positioned coaxially therein. The brake shoes are laterally restrained relative to either the tube or the barrel, whereby when the projectile-firing device is fired, urging means create friction between the brake shoes and either the barrel or the tube respectively and, when the projectile is fired, the recoil is mitigated. Thus, it will be understood by those skilled in the art that the movement of the brake shoes may be first laterally restrained relative to the barrel and apply sliding friction to the inner surface of the tube. In the alternative, the brake shoes may be laterally restrained relative to the tube and apply sliding friction to the outer surface of the barrel. In either circumstance, when the projectile is fired, the recoil is mitigated.

In a preferred embodiment of the present invention, the barrel of a projectile-firing device is adapted to include a pair of flanges around the outer surface of the barrel. The flanges are in a facing, spaced-apart relationship such that a pair of substantially semi-cylindrical brake shoes is accommodated therebetween in a nesting position preventing lateral movement of the brake shoes relative to the barrel while allowing the brake shoes to move radially relative to the barrel. Coil or other suitable springs are provided between the edges of each brake shoe wherein the brake shoes are urged in an outward radial direction. When the projectile-firing device, brake shoe pair, and coil spring combination is positioned coaxially within an elongated tube and a projectile fired, the springs urge the brake shoes against the inner surface of the tube creating friction and thus the recoil is mitigated. A variety of springs and/or spacers to foreshorten the springs provides the flexibility needed to match the friction to a variety of recoil mitigation needs.

Accordingly, the principle object of the present invention is to provide a friction brake recoil mitigation apparatus that is readily adapted to a variety of supports, projectile-firing devices, projectiles, and projectile velocities for mitigating the recoil of such devices when the device is fired. Further objects, advantages, and novel aspects of the present invention will become apparent from a consideration of the drawings and subsequent detailed description.

BRIEF DESCRIPTION OF THE DRAWINGS

The subsequent detailed description particularly refers to the accompanying figures in which.

DETAILED DESCRIPTION OF THE INVENTION AND BEST MODE

Figure 1:
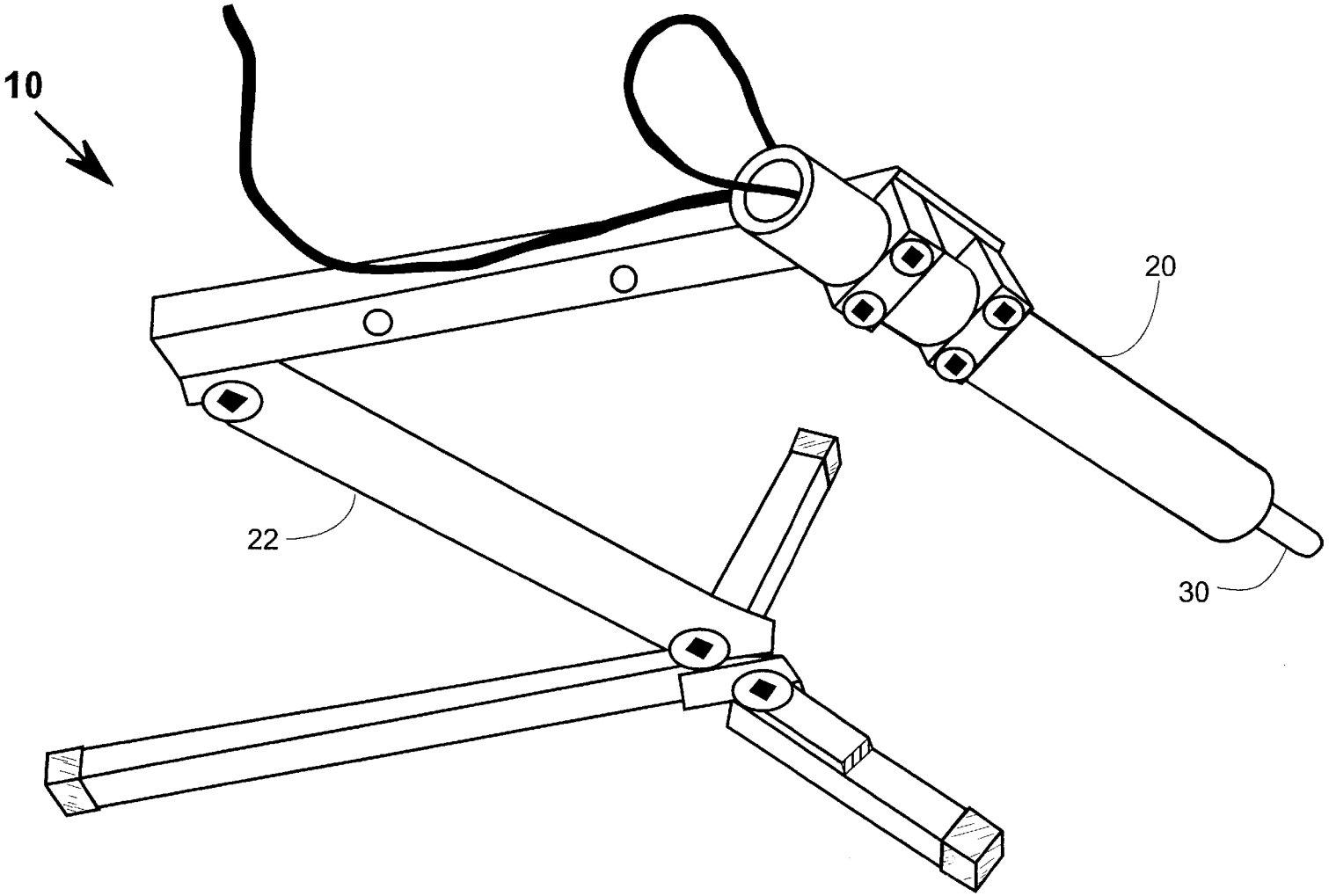
FIG. 1 is a perspective view of the recoil-mitigated projectile firing device.
Figure 2:
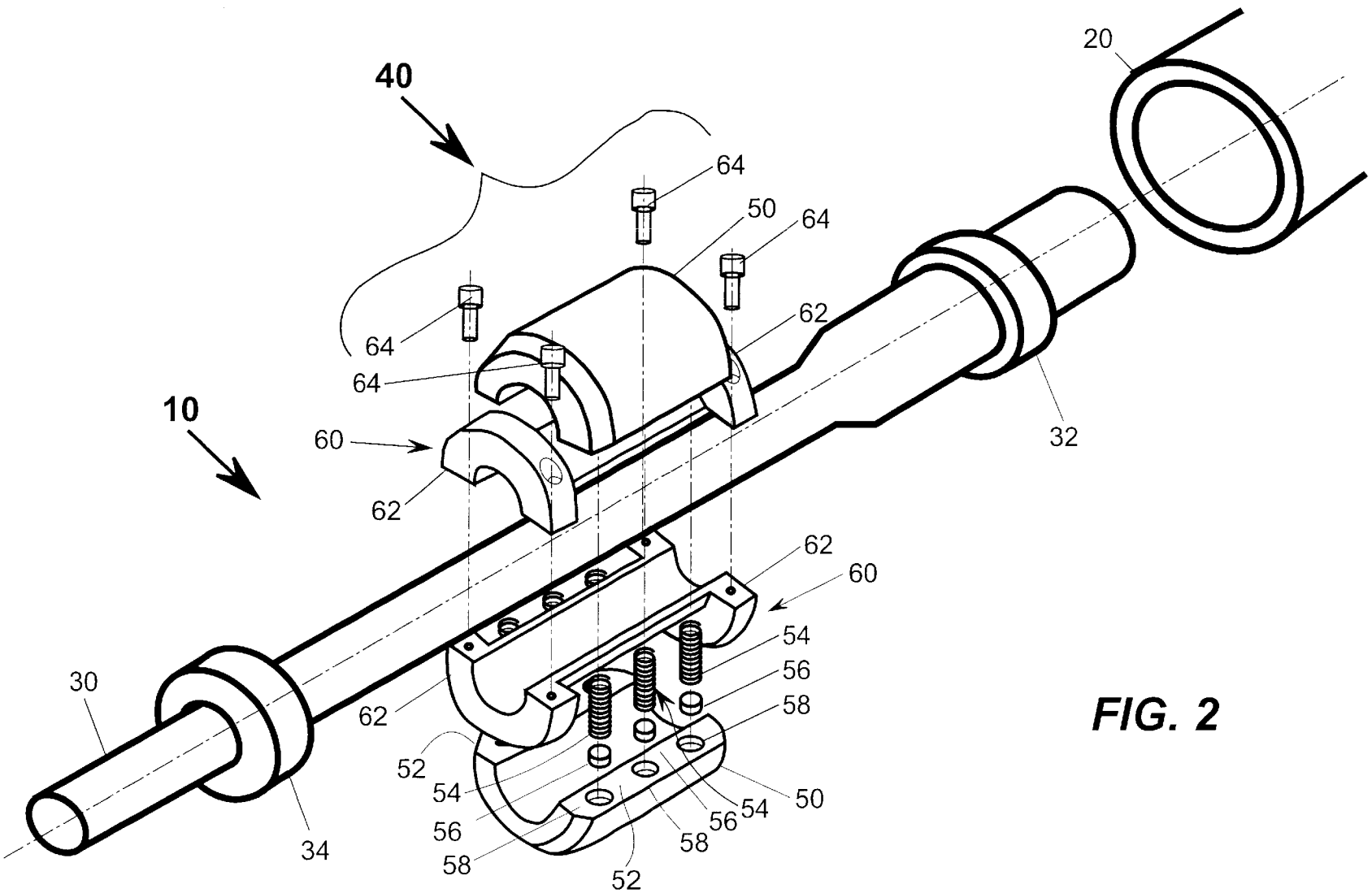
FIG. 2 is a exploded assembly view of the recoil-mitigated projectile-firing device according to the teachings of the present invention.

An exploded assembly view of a recoil-mitigated projectile-firing device is shown in FIG. 2. Barrel 30 represents a commercially available projectile-firing device. More specifically, an explosives disrupter such as a PAN (Percussion Actuated Non-electric) disrupter, distributed by Ideal Products, Lexington, Ky. under the trademark PAN DISRUPTER under license from Sandia National Laboratories, Albuquerque, N.Mex., a Lockheed Martin company, may be used. Other manufacturers of similar devices include, Royal Arms International, Woodland Hills, Calif. Such devices also typically include a breech enclosing a firing mechanism and means for firing the device (all not shown). A brake 40 is attached to the barrel 30 and the combination of the barrel 30 and the brake 40 is frictionally positioned within a guide tube 20 prior to firing. Typically, the guide tube 20 is attached to a support frame 22 (FIG. 1) or robotic device (not shown). As a reaction to the projectile being fired, the brake 40-barrel combination moves backward relative to the guide tube 20 and friction created between the brake 40 and the guide tube 20 acts to mitigate the recoil of the device 10. Thus, the energy of the sudden recoil impulse is partially converted to heat, is spread out over a longer period of time, and its maximum force is reduced. It is understood, however, that the brake 40 need not be attached to the barrel 30 and the combination move relative to the guide tube 20. It will be recognized by those skilled in the art, that it is within the scope and spirit of the invention that the brake 40 may be attached to the guide tube 20 and the barrel 30 move relative to the brake 40-guide tube 20 combination.

Figure 3:
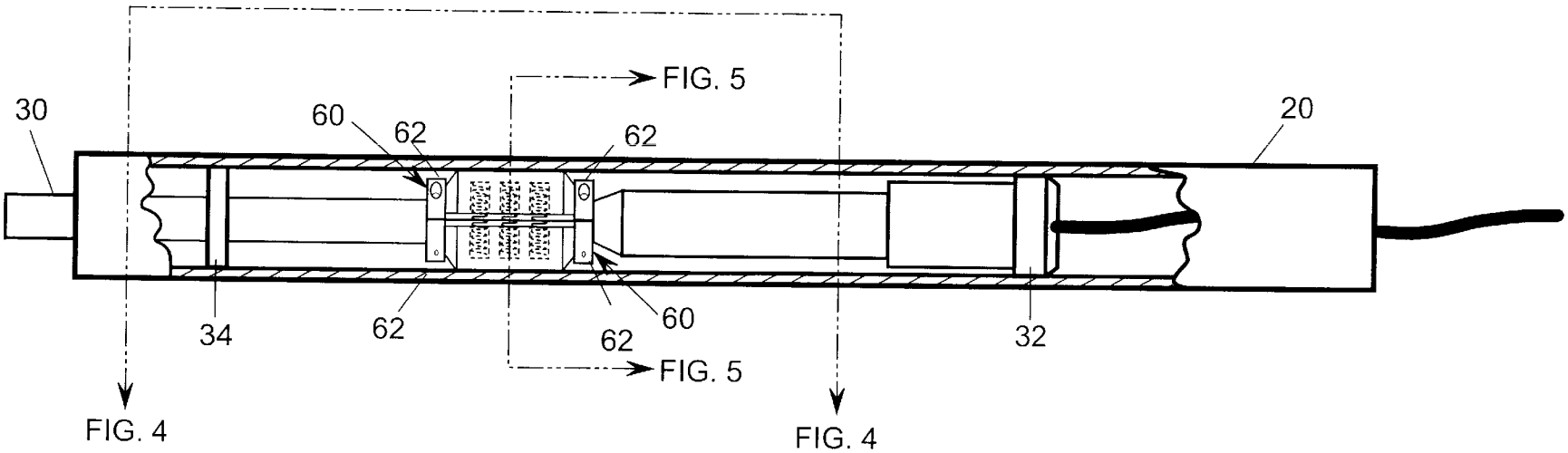
FIG. 3 is a cutaway elevation view of the recoil-mitigated projectile-firing device.
Figure 4:
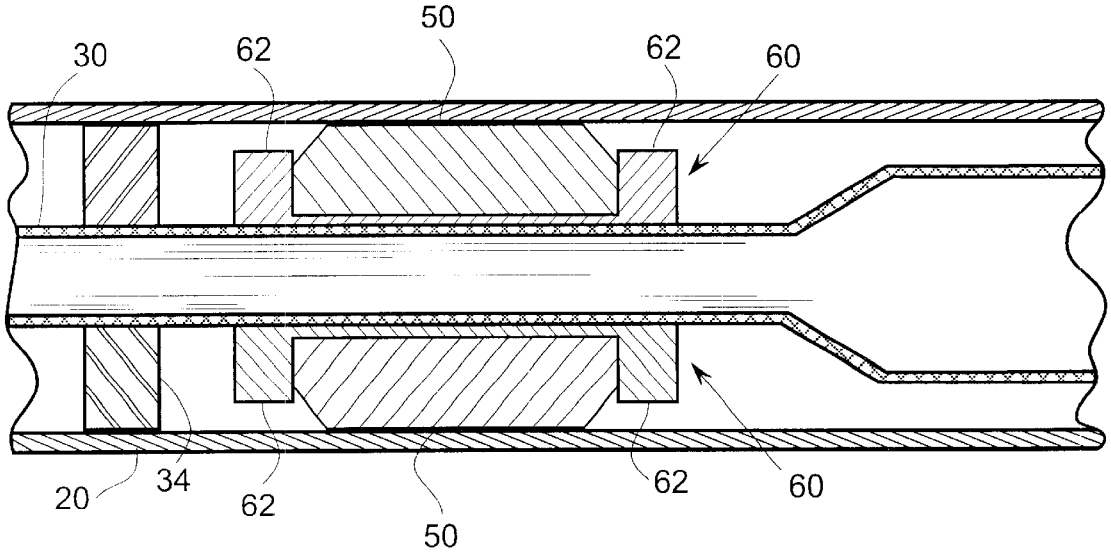
FIG. 4 is a lateral sectional view taken along the line 4—4 of FIG. 3.

As shown in FIGS. 2, 3, and 4, the brake 40 provides a friction, or stopping force with the guide tube 20 which mitigates the recoil motion of the device 10. The brake 40 includes a clamp 60 attachable to the barrel 30. (Also shown in FIG. 2.) As shown in FIGS. 2, 3, and 4, the clamp 60 is formed to include a first and a second flange 62 at either end. Two or more brake shoes 50 are sized to nest between flanges 62 whereby the lateral movement of the brake shoes 50 relative to the barrel 30 is restricted.

In a preferred embodiment, as shown in FIGS. 2, 3, 4, and 5, clamp 60 comprises two semi-cylindrical elements which are firmly attached to barrel 30 using screws 64 or other suitable means. Alternatively, the clamp 60 may be of a single-piece construction and slideable over the barrel 30 prior to being secured. Also, the clamp 60 may be secured with any suitable set screws, adhesive, or welded to the barrel 30. The flanges 62 of the clamp 60 thus restrict the lateral movement of the brake shoes 50 which allows the barrel 30 and brake 40 combination to frictionally slide together in the guide tube 20. Flanges 62 are also formed to allow each brake shoe 50 to move radially relative to the barrel 30. It will be recognized by those skilled in the art, that it is within the spirit and scope of the invention that the lateral movement of the brake shoes 50 relative to the barrel 30 may be restricted by suitable flanges or detents alone attached to, or formed with, the barrel 30.

Figure 5:
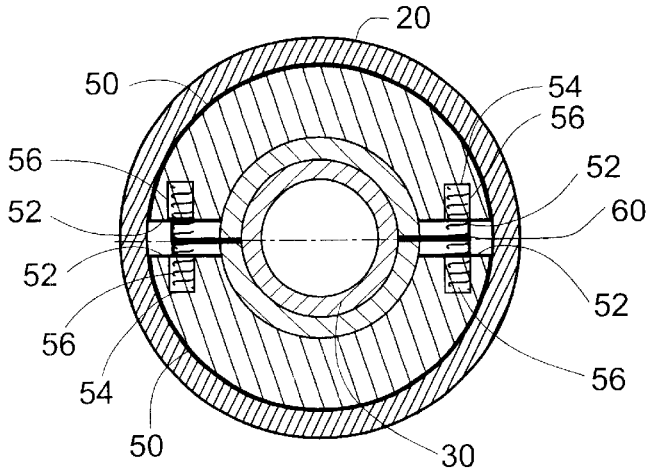
FIG. 5 is a cross-sectional view taken along the line 5—5 of FIG. 3.

In a preferred embodiment, as shown in FIGS. 2, 3, and 5, each brake shoe 50 is substantially C-shaped and substantially cylindroid and formed to include a pair of lands 52 running parallel to a long axis of each brake shoe 50 along each lateral edge. The shape of each brake shoe 50 conforms to the inner surface shape of the guide tube 20. This conformity provides frictional surface-to-surface contact between each brake shoe 50 and the inner surface of the guide tube 20. Thus, it will be recognized by those skilled in the art, that it is within the spirit and scope of the invention that the guide tube 20 may have a rectangular or any suitable cross-section. Each brake shoe 50, therefore, would be shaped to conform to such guide tube 20.

Figure 10:
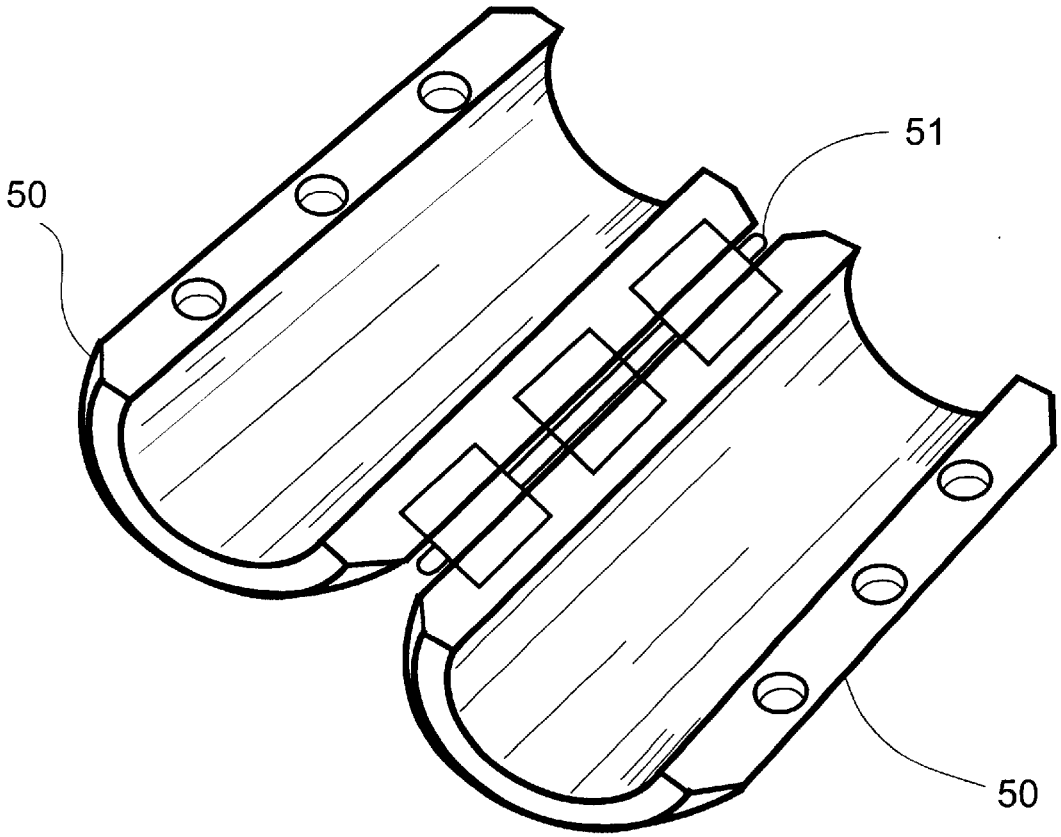
FIG. 10 is a perspective view of a clamshell design of the brake shoes.

In yet another embodiment, the brake shoes 50 are rotatably connected to each other with a hinge 51 or other similar means as shown in FIG. 10. In this embodiment, one or more springs 54, with or without spacers 58, may be employed on the opposite side of the brake shoes 50.

The actual friction, or stopping force is related to the normal force between the brake shoes 50 and the inner surface of the guide tube 20 by the following equation:

$$F_{stopping}=F_{normal}*\mu$$

where $\mu$ is the coefficient of friction between two materials. Book values of $\mu$ are available in many engineering texts or handbooks. For example, the ASM Handbook, Volume 18, Friction, Lubrication, and Wear Technology, ASM International (formerly American Society for Metals) (1992) reports values for a flat steel surface moving on another flat steel surface of 0.31 static and 0.23 kinetic. As will be appreciated by one skilled in the art, a higher force is required to overcome static (before the surfaces are in sliding motion relative to one another) friction than kinetic (once the surfaces are in sliding motion relative to one another) friction. From the same reference, for aluminum on steel the values are 0.25 static and 0.23 kinetic. Factors such as the basic material compositions as well as the finish of the surfaces affect the coefficients of friction.

In the preferred embodiment, pairs of coil springs 54 or other suitable urging means are positioned between opposing lands 52 of opposing brake shoes 50 to provide the force needed ($F_{normal}$) to frictionally contact each brake shoe 50 with the inner surface of the guide tube 20. As best seen in FIGS. 2 and 5, the end of each coil spring 54 is seated within a cavity 56 formed in the lands 52 of each brake shoe 50. Also, seen in FIG. 2, selected spacers 58 may be inserted into cavity 56. The spacers 58 thus provide that the coil springs 54 are further compressed and urge the brake shoes 50 against the inner surface of the guide tube 20 with greater force. As will be understood by one skilled in the art, the normal force ($F_{normal}$) exerted by various spring 54 and spacer 58 can be varied widely. Thus, the combination of coil springs 54 in both number of pairs and strength, and spacers in dimension, allows numerous combinations to provide the friction, or stopping force ($F_{normal}$) to match the intended application.

Coil springs 54 of three different strengths, manufactured by Lee Spring Company, Brooklyn, N.Y. were used. These included medium, medium heavy, and extra heavy. All were one-inch in length. Spacers 58 of three different dimensions were used. These included 0.1, 0.2, and 0.3-inch. Other suitable springs 54 and spacers 58 may be used as the circumstances warrant.

Figure 7:
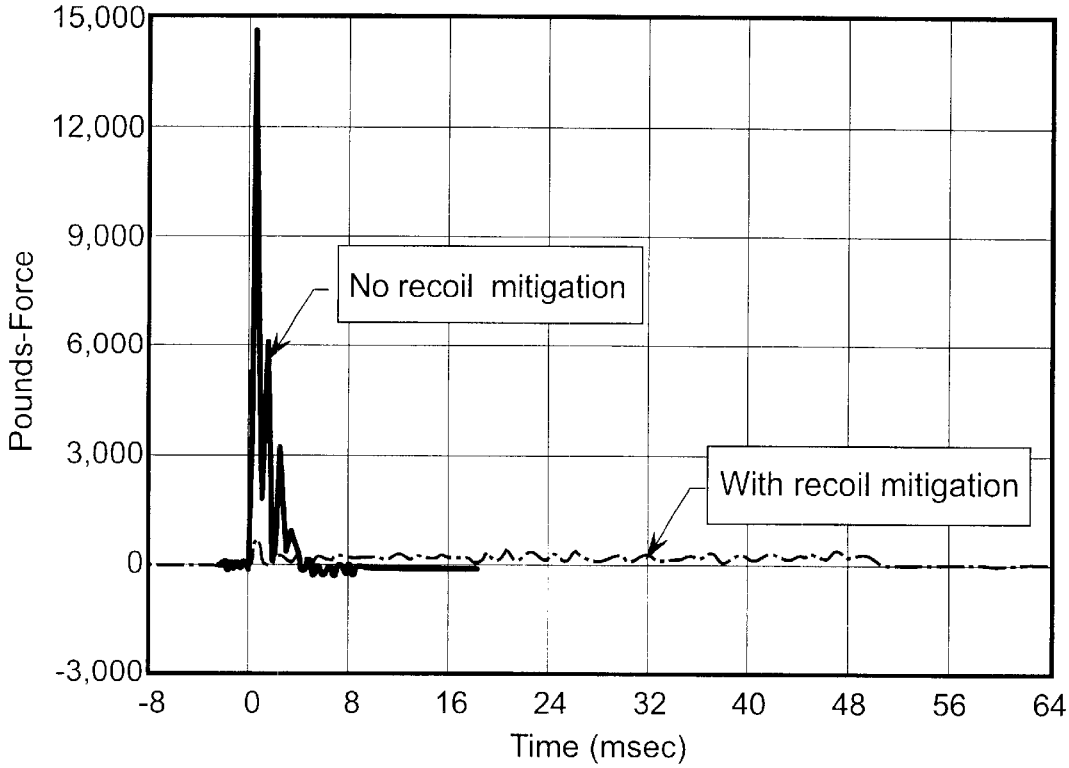
FIG. 7 is a graphical representation of the impulse curve for a non-mitigated recoil versus a mitigated recoil.

Selection of materials of construction of both the guide tube 20 and the brake shoes 50 also affects the friction, or stopping force. Travel distance and pounds-force experienced by the device 10 are important. As shown in FIG. 7, the combination of steel brake shoes 50 with an aluminum guide tube 20 gives good results. FIG. 7 shows the force curve measured with no recoil mitigation compared with the force curve measured with a recoil mitigation combination of an aluminum guide tube 20, steel brake shoes 50, three pairs of springs 54 (extra heavy), and three pairs of 0.1 inch spacers 58. (The use of an aluminum guide tube 20 also aids in managing the total added weight. Small remote-controlled robots used to support a disrupter can support only a limited amount of weight.) The curve shown in FIG. 7, for the "With recoil mitigation" example was produced with a spring pair 54-spacer 58 combination which provided a calculated normal force of 330 pounds-force. As shown in FIG. 7, the maximum static peak, a very short narrow pulse, was reduced from 14,638 pounds-force to 794 pounds-force. The approximate period of force pulse, the time period over which the recoil energy is dissipated, was increased from 5.1 milliseconds to 52 milliseconds. As stated above, the total impulse can be managed but not changed. As confirmation, the impulse for the test with no recoil mitigation was calculated to be approximately 13 pounds-force-seconds while the impulse for a test with recoil mitigation was calculated to be just over 13 pounds-force-seconds.

Alternatively, the outer surface of the brake shoes 50 and/or the inner surface of the tube 20 may comprise any suitable friction material such as those used in vehicle braking systems. Thus, for example, a friction material adapted for contact with the inner surface of the tube 20 may be bonded or otherwise adhered to the outer surface of the brake shoes 50. It will be appreciated by those skilled in the art, that it is within the spirit and scope of the invention that there are numerous combinations of materials that may be utilized to provide the desired recoil mitigation.

Figure 6:
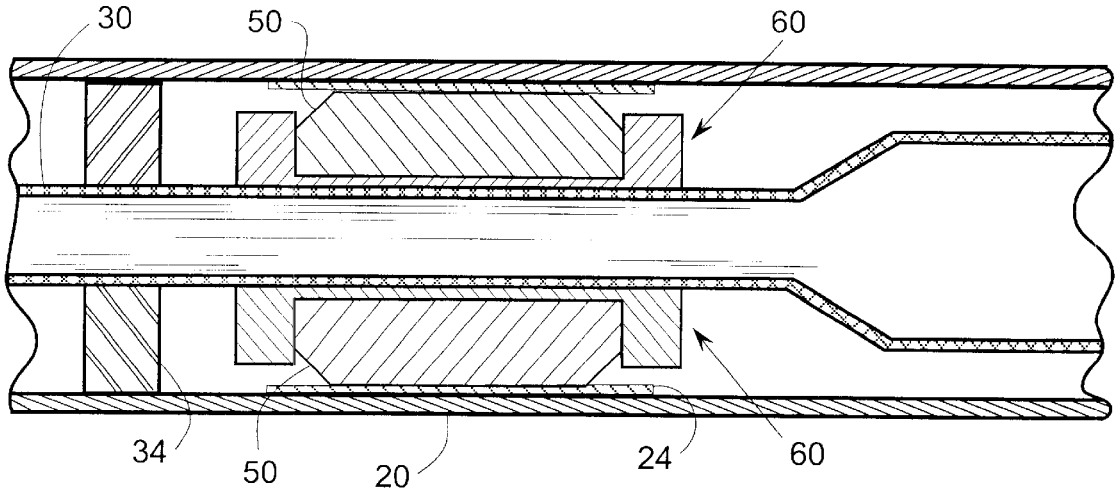
FIG. 6 is cross-sectional view taken along the line 6—6 of FIG. 3 showing a low-friction coating on a portion of the inner surface of a guide tube.

FIG. 7 shows that an initial static peak may occur as static friction is being overcome. As discussed above, the coefficient of static friction is larger than that of kinetic friction. Thus, a larger force peak is generated as this greater frictional resistance is overcome. This larger force peak may be reduced by modifying the inner surface of the guide tube 20 as shown in FIG. 6. This may be accomplished with a coating of low-friction material 24, such as polyethylene or other suitable material, on the inner surface of the guide tube 20 where the brake 40 is initially positioned. When the projectile is fired, the lower force necessary to overcome the static friction between the brake shoe 50 and the inner surface of the guide tube 20 with a low-friction material 24 reduces the initial static peak. When the brake 40 moves beyond the low-friction material 24 and begins sliding over the other material of the inner surface of the guide tube 20, the brake 40-barrel 30 combination is already moving and little or no additional static peak is produced.

As the barrel 30 is necessarily of somewhat narrower outside diameter than the inside diameter of the guide tube 20, means may be provided to prevent the barrel 30 from becoming canted in the guide tube 20. FIGS. 2 and 3 show an aft washer insert 32 and a fore washer insert 34. While these may be of any suitable material, polypropylene is satisfactory. It will also be appreciated by those skilled in the art that if the brake 40 is positioned on the barrel 30 in a generally fore position, the necessity of the fore washer insert 34 may be eliminated.

In operation, the clamp 60 is secured to the barrel 30 using screws 64. Fore washer insert 34 and aft washer insert 32 are positioned in a fore and aft position respectively on the barrel 30. A suitable combination of springs 54 and spacers 58 are selected for the application. The spacers 58 (if required) and the springs 54 are placed within the appropriate cavities 56 of one brake shoe 50. The pair of brake shoes 50 is then positioned within the flanges 62 of the clamp 60. The entire combination is then slid into guide tube 20. The assembled unit is positioned for firing and the projectile is fired. As the brake 40-barrel 30 combination is forced toward the aft position, the friction created by the brake shoes 50 and the inner surface of the guide tube 20 mitigates the recoil.

Figure 8:
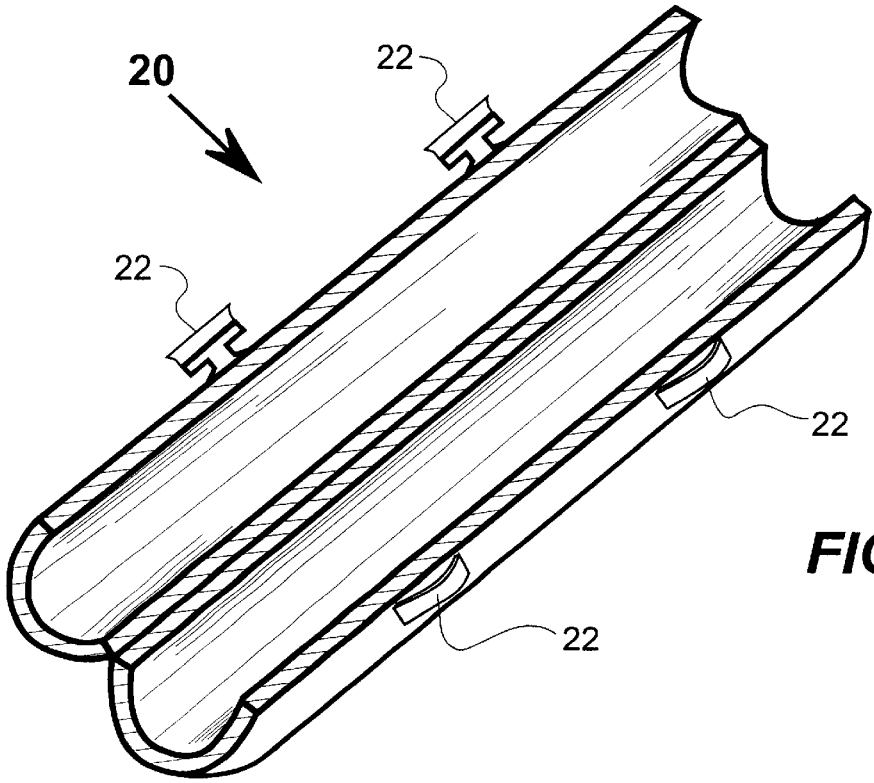
FIG. 8 perspective view of a clamshell design of a guide tube.

An alternative embodiment includes a guide tube 20 (FIG. 8) formed in a semi-cylindrical clamshell configuration. Instead of sliding the entire combination of barrel 30, clamp 60, brake 40, and springs 54 (or including spacers 58) into the guide tube 20, the guide tube 20 would be placed in the open position, the entire combination placed therein, and the guide tube 20 closed and secured with securing means 22.

Figure 9:
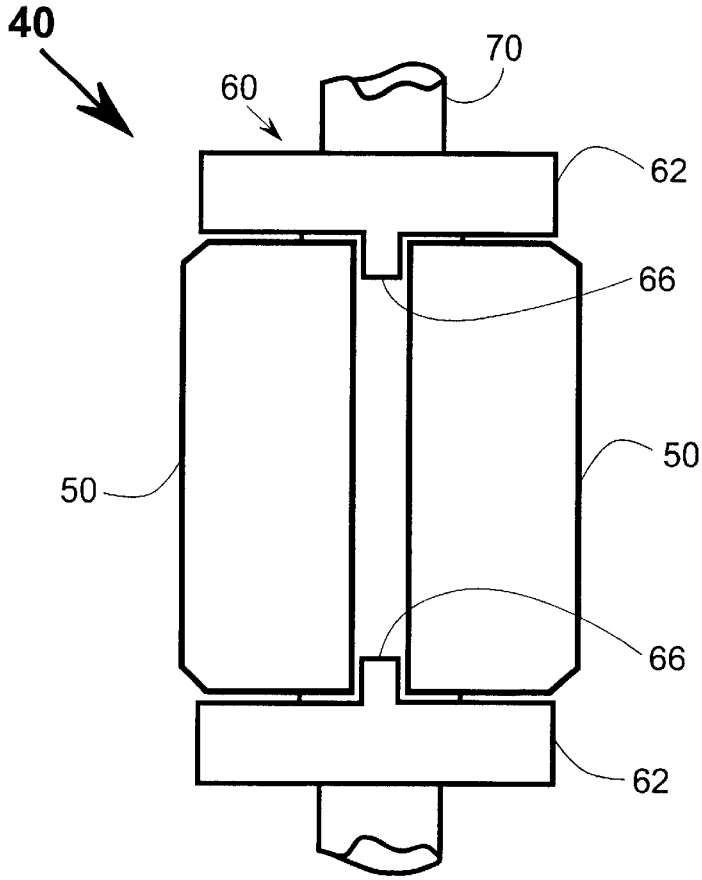
FIG. 9 is an elevation view showing a clamp formed to include shoulders to limit the rotational movement of the brake shoes.

FIG. 9 shows yet another embodiment which includes a clamp 60 formed to include shoulders 66. Thus, a rotational element 70 may be braked with the braking device of the present invention. The shoulders 66 prevent the brake shoes 50 from rotating about the axis of rotation and the friction created between the brake shoes 50 and the inner surface of the guide tube 20 and the rotational element is braked.

Although the invention has been described in detail with reference to certain preferred embodiments, variations and modifications exist within the scope and spirit of the invention as described and defined in the following claims.

We claim:

1. A recoil-mitigated projectile-firing device, the projectile-firing device comprising:

an elongated tube;

a barrel adapted for firing a projectile, the barrel positioned coaxially within the tube; and a brake attached to the barrel, the brake comprising:

two or more brake shoes, each shoe adapted to frictionally contact the inner surface of the tube and adapted to be positioned in a free space defined by the outer surface of the barrel and the inner surface of the tube;

means attached to the barrel for limiting the lateral movement of the brake shoes relative to the barrel; and means for urging the brake shoes in an outward radial direction, the brake interposed between the barrel and the inner surface of the tube, the brake further in frictional contact with the inner surface of the tube, whereby when the projectile is fired from the barrel, the brake mitigates the recoil of the device.

2. The device of claim 1, wherein the elongated tube is attached to a frame.

3. The device of claim 1, wherein the limiting means is a first and a second detent lying in a facing, spaced-apart relationship.

4. The device of claim 1, wherein the limiting means is a first and a second flange lying in a facing, spaced-apart relationship.

5. The device of claim 1, wherein the limiting means comprises a clamp attached coaxially to the outside of the barrel, the clamp formed to include a detent at each end.

6. The device of claim 1, wherein the limiting means comprises a clamp attached coaxially to the outside of the barrel, the clamp formed to include a flange at each end.

7. The device of claim 1, wherein the tube is substantially cylindroid.

8. The device of claim 7, wherein the brake shoes are each substantially C-shaped and substantially cylindroid, the brake shoes formed to include a first and a second land running parallel to the long axis of each brake shoe along each lateral edge of the C, each land formed to include at least one cavity, whereby each cavity faces the at least one cavity in an opposing land of an adjacent shoe.

9. The device of claim 8, wherein the urging means comprises a coil spring interposed between each pair of opposing lands, the springs being partially positioned within the opposing cavities of adjacent lands.

10. The device of claim 1, wherein the inner surface of the tube in frictional contact with the brake immediately prior to firing is a low-friction material.

11. The device of claim 10, wherein the low-friction material is polypropylene.

12. The device of claim 1, wherein the guide tube is a pair of semi-cylindroids.

13. The device of claim 12, wherein the pair of semi-cylindroids is hinged together along one lateral side.

14. The device of claim 13, wherein the pair of semi-cylindroids further comprises at least one means for holding the semi-cylindriods together, whereby a cylindrical tube is formed.

15. The device of claim 1, further including one or more washer inserts positioned in a portion of the free space between the barrel and the inner surface of the tube, whereby the barrel is supported within the tube.

16. The device of claim 1, wherein the brake shoes comprise a friction material attached to the surface thereof.

17. The device of claim 1, wherein the tube comprises a friction material attached to the inner surface thereof.

18. The device of claim 1, wherein the number of brake shoes is two and wherein the brake shoes are rotatably connected together.

19. A recoil mitigation apparatus for a projectile-firing device, the projectile-firing device comprising a barrel for housing a projectile, the recoil mitigation apparatus comprising:

an elongated tube attached to a frame;

a brake comprising:

a substantially cylindrical clamp adapted to be attached coaxially to the outside of the barrel, the clamp formed to include a flange at each end;

two or more substantially C-shaped substantially cylindroid brake shoes, the inner concave surface of each shoe adapted to mate with a respective arcuate portion of the outer convex surface of the clamp, and wherein each shoe is sized to lie between the flanges, each brake shoe having a first and a second land, each land running parallel to the long axis of the shoe along lateral edges of the C, and wherein each land is formed to include at least one cavity; and two or more urging means, each urging means having a first end and a second end, each end of each urging means formed to partially engage within a cavity; and wherein when the clamp is secured to the outside of the barrel, each shoe mated with the outer convex surface of the barrel and positioned between the flanges, the brake shoes urged apart by the urging means positioned within opposing cavities, and when the barrel, clamp, brake shoes, and springs assembly is fit coaxially frictionally within the tube, when the projectile is fired from the barrel, the recoil of the device is mitigated.

20. A recoil-mitigated projectile-firing device, the projectile-firing device comprising:

an elongated tube attached to a frame;

a barrel adapted for housing and firing a projectile the barrel positioned coaxially within the tube;

a substantially cylindrical clamp positioned between the tube and the barrel, the clamp attached coaxially to the outside of the barrel, the clamp formed to include a flange at each end;

two or more substantially C-shaped substantially cylindroid brake shoes interposed between the clamp and the tube, each shoe having a first and a second land running parallel to the long axis of the shoe along each lateral edge of the C, each land formed to include at least one cavity, the inner concave surface of each brake shoe mated with a respective arcuate portion of the outer convex surface of the clamp and positioned between the flanges, whereby the at least one cavity in each land faces the at least one cavity in a land of the opposing shoe; and an urging means, having a first end and a second end, positioned between each land of each opposing shoe, the first end positioned within the at least one cavity of one land and the second end positioned within the at least one cavity of the land of the opposing shoe, whereby the shoes are urged in an outward radial direction against the inner surface of the tube, whereby when a projectile is fired from the barrel, the friction created between the shoes and the tube mitigates the recoil of the device.

21. A recoil mitigation apparatus for a projectile-firing device, the projectile-firing device comprising a barrel for housing a projectile, the recoil mitigation apparatus comprising:

an elongated tube attached to a frame;

a brake comprising:

first and second substantially semi-cylindrical clamp elements, each clamp element adapted to be attached coaxially to the outside of the barrel, each clamp element formed to include a flange at each end, the first and second clamp elements positioned on opposite sides of the barrel in a face-to-fact relationship, the clamp elements secured together with securing means, whereby the clamp is securely attached to the barrel;

first and second substantially semi-cylindrical brake shoes sized to lie between the flanges, each shoe comprising and inner surface adapted to mate with a respective arcuate portion of the outer convex surface of the clamp, a first and a second land, each land running parallel to the long axis of the shoe along the lateral edges of the semi-cylinder, the first and second shoes positioned on opposite sides of the clamp in a face-to-face relationship, the shoes being restricted in the lateral direction by the flanges and the shoes being urged apart in an outward radial direction by urging means; and the barrel and brake combination further positioned within the tube, whereby urging means urge the shoes against the inner convex surface of the tube, and whereby when a projectile is fired from the barrel, the friction created between the shoes and the tube mitigates the recoil of the device.

22. A brake for mitigating the recoil of a projectile-firing device having a barrel, the barrel positioned coaxially within a tube, the brake comprising:

two or more brake shoes adapted to frictionally contact the inner surface of the tube and adapted to be positioned in the annular space between the outer surface of the barrel and the inner surface of the tube;

means adapted to attach to the barrel for limiting the lateral movement of the brake shoes relative to the barrel; and means for urging the brake shoes in an outward radial direction when the barrel is positioned within the tube, whereby the brake shoes frictionally contact the tube.

23. A brake for mitigating the recoil of a projectile-firing device having a barrel, the barrel positioned coaxially within a tube, the brake comprising:

two or more brake shoes adapted to frictionally contact the outer surface of the barrel and adapted to be positioned in the annular space between the inner surface of the tube and the outer surface of the barrel;

means adapted to attach to the tube for limiting the lateral movement of the brake shoes relative to the tube; and means for urging the brake shoes in an inward radial direction when the barrel is positioned within the tube, whereby the brake shoes frictionally contact the barrel, and wherein when the device is fired, a force-time profile of the recoil is substantially constant.

24. A method for firing a projectile with mitigated recoil, the method comprising the steps of:

(a) providing an elongated tube;

(b) providing a projectile-firing device, the projectile-firing device comprising a barrel, having a breech attached thereto, adapted for firing a projectile;

(c) attaching a brake to the barrel;

(d) positioning the barrel coaxially within the tube, wherein the brake makes frictional contact with the inner surface of the tube (e) firing the projectile from the barrel, whereby the brake mitigates the recoil.

25. A method for firing a projectile with mitigated recoil, the method comprising the steps of:

(a) providing a projectile-firing device, the projectile-firing device comprising a barrel for housing a projectile;

(b) attaching a substantially cylindrical clamp to the outer convex surface of the barrel, the clamp formed to include a first flange at one end and a second flange at the other end;

(c) positioning first and second substantially semi-cylindrical brake shoes along opposite sides of the clamp and between the first flange and the second flange, whereby the flanges restrain the shoes in the lateral direction;

(d) providing means for urging the shoes apart in an outward radial direction;

(e) pressing the shoes together, whereby the urging means become compressed;

(f) inserting the projectile-firing device, clamp, shoes, urging means combination into an elongated tube attached to a support frame; and (g) firing the projectile from the barrel, whereby the friction between the shoes and the tube mitigates the recoil.

26. The method of claim 25, further comprising the step of selecting urging means according to the projectile to be fired and the recoil mitigation desired.

27. A kit for mitigating the recoil of a projectile-firing device, the projectile-firing device comprising a barrel, the kit comprising:

an elongated tube;

a clamp adapted to be attached to the barrel, the clamp comprising a flange at each end;

a pair of brake shoes, a first surface of each brake shoe adapted to conform to the inner surface of the tube and a second surface of each brake shoe adapted to substantially conform to the outer surface of the clamp, each brake shoe sized to lie between the flanges; and a selection of urging means adapted to be interposed between the brake shoes, whereby the brake shoes may be urged in an outward radial direction.

28. The kit of claim 27, further comprising a selection of spacers adapted to be interposed between the brake shoes and the springs, whereby the brake shoes may be urged with more force in an outward radial direction.

29. The brake of claim 23, wherein the urging means comprises a plurality of springs.

30. The brake of claim 29, wherein at least one of the plurality of springs has an axis of compression and the spring axis of compression is substantially orthogonal to a long axis of the tube.

* * * * *